US011008851B1

(12) United States Patent
Yin et al.

(10) Patent No.: US 11,008,851 B1
(45) Date of Patent: May 18, 2021

(54) ULTRASONIC WELLBORE ANTI-COLLISION MONITORING SYSTEM AND MONITORING METHOD

(71) Applicant: SOUTHWEST PETROLEUM UNIVERSITY, Sichuan (CN)

(72) Inventors: Hu Yin, Chengdu (CN); Qifu Xiao, Chengdu (CN); Qian Li, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 16/809,600

(22) Filed: Mar. 5, 2020

(30) Foreign Application Priority Data

Dec. 3, 2019 (CN) ..... 201911216691.8

(51) Int. Cl.
*E21B 47/0224* (2012.01)
*E21B 47/107* (2012.01)
*E21B 47/14* (2006.01)

(52) U.S. Cl.
CPC ..... *E21B 47/0224* (2020.05); *E21B 47/107* (2020.05); *E21B 47/14* (2013.01)

(58) Field of Classification Search
CPC .... E21B 17/1014; E21B 47/09; E21B 47/095; E21B 47/0224; E21B 47/14; E21B 7/04; E21B 7/06; E21B 7/10
See application file for complete search history.

(56) References Cited

U.S. PATENT DOCUMENTS 5,131,477 A * 7/1992 Stagg ..... E21B 47/02 175/40
9,127,530 B2 * 9/2015 Lowdon ..... E21B 47/0224
(Continued)

FOREIGN PATENT DOCUMENTS

CN 201460860 U 5/2010
CN 104781503 A 7/2015
(Continued)

OTHER PUBLICATIONS

First Office Action in Chinese Application No. 201911216691.8 dated Apr. 10, 2020, 20 pages.

*Primary Examiner* — Jennifer H Gay
(74) *Attorney, Agent, or Firm* — Yuqin Jin

(57) ABSTRACT

The present invention discloses an ultrasonic wellbore anti-collision monitoring system, comprising a downhole ultrasonic monitoring device and a ground control system, wherein the ultrasonic monitoring device includes a cylindrical body, at least three centralizers are fixed on the cylindrical body at an equal interval, the mounting groove 1 is cut into the cylindrical body surface between two adjacent centralizers, one electrically controlled expansion device is installed in the groove 1 and includes electric push rods placed horizontally and a ribbed plate perpendicular to the electric push rods, the bottom ends of the electric push rods are fixedly connected to the bottom surface of the mounting groove, the front ends of the electric push rods are connected with the ribbed plate, the mounting groove 2 is cut into the ribbed plate, and one ultrasonic transducer is installed in the groove 2. The ground control system controls the ultrasonic transducer to emit S wave and receive the reflected wave, and calculates the distance between the two wells by monitoring the time difference between the emission time and the reflection time in combination with the travel velocity of S wave in the formation. The wellbore anti-collision monitoring system is simple in structure and easy in monitoring operation.

3 Claims, 7 Drawing Sheets

(56) References Cited

U.S. PATENT DOCUMENTS

| | | | | |
|---|---|---|---|---|
| 9,243,454 | B2 * | 1/2016 | Wenzel | E21B 7/06 |
| 10,119,389 | B2 * | 11/2018 | Donderici | E21B 47/02 |
| 2010/0284250 | A1 * | 11/2010 | Cornish | E21B 47/0224 367/124 |
| 2011/0080807 | A1 * | 4/2011 | Instanes | E21B 7/04 367/41 |
| 2014/0131112 | A1 * | 5/2014 | Wenzel | E21B 7/10 175/76 |
| 2014/0262507 | A1 * | 9/2014 | Marson | E21B 7/062 175/24 |
| 2016/0265343 | A1 * | 9/2016 | Donderici | E21B 43/305 |
| 2016/0349082 | A1 * | 12/2016 | Marson | E21B 47/12 |
| 2017/0096890 | A1 * | 4/2017 | Hartog | E21B 7/06 |
| 2018/0202288 | A1 * | 7/2018 | Elbadawy | E21B 7/04 |

FOREIGN PATENT DOCUMENTS

| | | | | | |
|---|---|---|---|---|---|
| CN | 105986810 | A | | 10/2016 | |
| CN | 107642355 | A | | 1/2018 | |
| CN | 109083632 | A | | 12/2018 | |
| CN | 109667550 | A | | 4/2019 | |
| CN | 110275223 | A | | 9/2019 | |
| GB | 2474130 | A | * | 4/2011 | E21B 47/0224 |
| WO | WO-2007014446 | A1 | * | 2/2007 | G01C 21/16 |
| WO | WO-2009073008 | A1 | * | 6/2009 | E21B 44/005 |
| WO | WO-2015099790 | A1 | * | 7/2015 | E21B 47/0228 |
| WO | WO-2017044103 | A1 | * | 3/2017 | G01V 1/52 |

* cited by examiner

Schematic Diagram of Wellhead Orientation of Well under Drilling

Schematic Diagram of Wellhead Orientation of Adjacent Well

ULTRASONIC WELLBORE ANTI-COLLISION MONITORING SYSTEM AND MONITORING METHOD

CROSS REFERENCE

This application claims priority of Chinese Patent Application No. 201911216691.8 filed on Dec. 3, 2019, the entire contents of which are hereby incorporated by reference.

TECHNICAL FIELD

The present invention relates to the technical field of oil and gas drilling, in particular to a technical monitoring device and a monitoring method for real-time monitoring the distance between two wells by ultrasonic wave.

BACKGROUND

With the more intensive development of various oilfields, the development of remaining oil and marginal oil reservoir in old oilfields has become an important way to increase reserves and production. As a result, there are more adjustment wells, progressive development wells, and cluster wells developed in the oilfields, and more special wells gradually drilled in the oilfields, increasing the density of well patterns, reducing the distance between wells, drilling more layered exploitation wells, and increasing the development of cluster wells in urban areas, etc. At the same time, it is an important measure for reserve and production improvement to find thin bed reservoir and hard-to-recover reserves in high-density well gaps in old oilfields. With the wide application of non-conventional wells in major oilfields, the number of cluster wells is increasing, and the distance between wells is getting smaller and smaller. In the process of drilling cluster wells or adjusting wells in old oilfields, there is an increase in the collision of two wells in the vertical interval and deviated interval, and frequent occurrence of abandoned footage and repeated construction. The environmental problems and economic losses caused by wellbore collision may be catastrophic.

Therefore, it is more and more important to evaluate the wellbore track and avoid the risk of wellbore collision. The collision prevention is the core issue to ensure the safe and rapid construction of dense wellhead cluster well groups. The collision prevention is involved in pre-drilling preparation, engineering design, construction and other aspects of dense wellhead cluster well groups. During the drilling process, the uncertainty of the geological target and kick-off rate of the formation has brought certain difficulties to the construction of cluster wells. There are unpredictable risks. How to keep the distance between the drill bit and the adjacent well within the safe distance has become a key problem in cluster well development. For well areas with dense wellbores, the collision prevention between the wellbore tracks is the core issue to ensure the safe and rapid construction of dense wellhead cluster well groups. In the existing method, the distance between two wells can be calculated only by scanning, and there is error between the theoretical calculation value and the actual value.

SUMMARY

An object of the present invention is to provide a monitoring system and a monitoring method to monitor the distance between the two wells in real time by ultrasonic wave to solve the problem found in the calculation of distance of two wells by existing scanning method and the error between the theoretical calculation value and the actual value, which is used for the ultrasonic anti-collision monitoring of the wellbore.

An aspect of the present disclosure provides an ultrasonic wellbore anti-collision monitoring system. The ultrasonic wellbore anti-collision monitoring system includes a downhole ultrasonic monitoring device and a ground control system. The ultrasonic monitoring device includes a body. A connection member for connecting ground drawworks is arranged on the top of the body. At least three centralizers are fixed on a body surface, and an electrically controlled expansion device is installed in the body surface between two adjacent centralizers. The electrically controlled expansion device includes one or more electric push rods placed horizontally and a ribbed plate perpendicular to the one or more electric push rods, bottom ends of the one or more electric push rods are connected to the body, front ends of the one or more electric push rods are connected to the ribbed plate, and an ultrasonic transducer is installed on the ribbed plate. The electronically controlled expansion device is connected to the ground control system to control the extension and retraction of the one or more electric push rods, when the one or more electric push rods are retracted, a horizontal protruding height of the ultrasonic transducer is smaller than horizontal heights of two centralizers adjacent to the ultrasonic transducer, when the one or more electric push rods are extended, the horizontal protruding height of the ultrasonic transducer is equal to the horizontal heights of the two centralizers adjacent to the ultrasonic transducer, and the ultrasonic transducer is close to the wellbore casing. The ground control system controls the ultrasonic transducer to emit S wave and receive the reflected wave, and calculates the distance between the two wells by monitoring the time difference between the emission time and the reflection time in combination with the travel velocity of S wave in the formation.

In some embodiment, material hardness of the two centralizers adjacent to the ultrasonic transducer is greater than material hardness of other centralizers.

The ultrasonic wellbore anti-collision monitoring system disclosed by the present invention includes downhole ultrasonic monitoring device and ground control system. The ultrasonic monitoring device includes a cylindrical body, a lifting cap is arranged on the top of the body, and a lifting bail for connecting the ground drawworks is arranged on the top of the lifting cap. The preferred structure is that the upper end of the cylindrical body is provided with a box, the lifting cap is provided with a pin, the body is connected with the lifting cap by thread, and a lifting bail is arranged on the top of the lifting cap and connected with the ground drawworks to lift up and lower the ultrasonic monitoring device.

At least three centralizers are fixed with an equal interval on the surface of the cylindrical body, preferably four strip centralizers. The axis of the strip centralizers is parallel to the axis of the cylindrical body. The mounting groove 1 is cut into the cylindrical body surface between two adjacent centralizers, one electrically controlled expansion device is installed in the groove 1 and includes electric push rods placed horizontally and a ribbed plate perpendicular to the electric push rods, the bottom ends of the electric push rods are fixedly connected to the bottom surface of the mounting groove, the front ends of the electric push rods are connected with the ribbed plate, the mounting groove 2 is cut into the ribbed plate, and one ultrasonic transducer is installed in the groove 2.

In some embodiments, there is at least one electric push rod that is synchronized to expand and retract and is connected to the ribbed plate in a uniform distribution. At least one electric push rod can always make the upper surface of the ribbed plate or the ultrasonic transducer in the mounting groove 2 parallel to the axis of the cylindrical body, so that the ultrasonic transducer can be close to the wellbore casing.

In some embodiments, there are three electric push rods including an electric push rod 1, an electric push rod 2, and an electric push rod 3; the front end of the electric push rod 1 is connected to a geometric center point of the ribbed plate; and the electric push rod 2 and the electric push rod 3 are respectively located on different sides of the electric push rod 1 and are connected to the ribbed plate in an equidistant distribution.

The ultrasonic transducer is used to generate ultrasonic S wave (SH wave) and receive the reflected S wave. Ultrasonic S wave can only travel in solid media, and cannot travel and be reflected back in liquids and air. The ultrasonic S wave may include a horizontally polarized S wave (SH wave), which does not undergo waveform conversion and travels in simple SH waveform in the whole travel process, which makes the SH wave is not interfered by other waves during the travel process. With the increase of travel distance, the attenuation of this wave is much smaller than other waves. Therefore, this wave is most suitable for detecting the distance between two wells.

The electronically controlled expansion device is connected to the ground control system to control the extension and retraction of the electric push rod. When the electric push rods are retracted, the horizontal protruding height of the ultrasonic transducer is smaller than the horizontal height of two centralizers adjacent to it. When the electric push rods are extended, the horizontal protruding height of the ultrasonic transducer is equal to the horizontal height of two centralizers adjacent to it, and the ultrasonic transducer is close to the wellbore casing. The ground control system controls the ultrasonic transducer to emit S wave and receive the reflected wave, and calculate the distance between the two wells by monitoring the time difference between the emission time and the reflection time in combination with the travel velocity of S wave in the formation. The two centralizers adjacent to the ultrasonic transducer are made of hard material, and the rest are made of elastic material. The upper part of the cylindrical body is provided with a cable hole through which the cable is connected to the ground control system and the downhole ultrasonic monitoring device.

With the an-collision monitoring method by the ultrasonic wellbore anti-collision monitoring system, the main technical solution is that the nearest area (vertical depth) between two adjacent wells is found out by anti-collision scanning, the ultrasonic monitoring device is lowered by the drawworks to the specified vertical depth (where the two wells are closest) in the well adjacent to the well under drilling, the ultrasonic transducer is supported on the casing wall of the adjacent well, the ultrasonic monitoring device is controlled by the ground control system to emit S wave perpendicular to the casing wall of the adjacent well, the S wave encounters the drilling fluid in the well under drilling during the travel, and cannot continue to travel, but is reflected back along the original path, and the ground control system calculates the distance S between the two wells by monitoring the time difference T between the emission time and the reflection time of the S wave and the travel velocity V of the S wave in the formation; the calculation formula is $$S = \frac{V \times T}{2}.$$

The monitoring mode varies with the type of well interval. The details are described as follows:

(1) For the wellbore anti-collision monitoring in the vertical interval, the real-time monitoring mode is adopted, including the following steps:

Step 1: Calculate the vertical depth a of measuring point with track calculation software according to inclination and azimuth measured by MWD of the well under drilling;

Step 2: Lower the ultrasonic monitoring device by the drawworks to the vertical depth a calculated in Step 1;

Step 3: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells;

Step 4: After completing Steps 1 to 3, control the closing of the electric push rods with the ground control system, lower the ultrasonic monitoring device by the drawworks at a velocity that is same with drilling rate of the well under drilling until it runs into the well 2 m deep, and then repeat Steps 3 and 4 in turns to continue to measure the distance between the two wells in the vertical interval;

Step 5: After the measurement is completed, control the closing of the electric push rods with the ground control system, start up the drawworks to lift up the ultrasonic monitoring device and lift it away from the wellhead.

(2) For the wellbore anti-collision monitoring in the kick-off interval, the precise measurement mode is adopted, including the following steps:

Step 1: Calculate the track parameter with track calculation software according to downhole inclination and azimuth measured by MWD of the well under drilling;

Step 2: Calculate the nearest distance between the well under drilling and the adjacent well by anti-collision scanning, work out the vertical depth a and azimuth b of the nearest point of the well under drilling to the adjacent well, and then calculate the monitoring azimuth c of the adjacent well; if the currently measured azimuth is 0° to 180°, c=360°−b; if 180° to 360°, c=b;

Step 3: Use a compass to determine the position d of the measured azimuth c measured at the wellhead of the adjacent well, to align the position of the ultrasonic transducer with the position d;

Step 4: Lower the ultrasonic monitoring device by the drawworks to the vertical depth a according to the requirements set forth in Step 3;

Step 5: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells; after that, lift up the ultrasonic monitoring device and lift it away from the wellhead to monitor the next point, and repeat Steps 1 to 5.

(3) For the anti-collision monitoring of the interval with higher risk of collision, the real-time monitoring+single-point accurate measurement is adopted, including the following steps:

Step 1: Calculate the vertical depth a of measuring point with track calculation software according to inclination and azimuth measured by MWD of the well under drilling;

Step 2: Lower the ultrasonic monitoring device by the drawworks to the vertical depth a calculated in Step 1;

Step 3: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells;

Step 4: After completing Steps 1 to 3, control the closing of the electric push rods with the ground control system, lower the ultrasonic monitoring device by the drawworks at a velocity that is same with drilling rate of the well under drilling until it runs into the well 2 m deep, and then repeat Steps 3 and 4 to conduct real-time monitoring;

Step 5: In the process of real-time monitoring, if there is a trend of collision between the two wells, that is, the distance between the two wells is continuously decreased, switch to the precise measurement mode, and lift up the ultrasonic monitoring device and lift it away from the wellhead as follows:

Step 51: Calculate the track parameter with track calculation software according to downhole inclination and azimuth measured by MWD of the well under drilling;

Step 52: Calculate the nearest distance between the well under drilling and the adjacent well by anti-collision scanning, work out the vertical depth a and azimuth b of the nearest point of the well under drilling to the adjacent well, and then calculate the monitoring azimuth c of the adjacent well; if the currently measured azimuth is 0° to 180°, c=360°−b; if 180° to 360°, c=b;

Step 53: Use a compass to determine the position d of the measured azimuth c measured at the wellhead of the adjacent well, to align the position of the ultrasonic transducer with the position d;

Step 54: Lower the ultrasonic monitoring device by the drawworks to the vertical depth a according to the requirements set forth in Step 3;

Step 55: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells; after that, lift up the ultrasonic monitoring device and lift it away from the wellhead to monitor the next point, and repeat Steps 1 to 5.

Compared with the prior art, the present invention has the following beneficial effects:

The ultrasonic monitoring wellbore anti-collision monitoring system disclosed by the present invention is advantaged by simple structure, low cost, and real-time monitoring of distance between two adjacent wells. It is used to prevent the wellbore collision of two adjacent wells, and provide more accurate monitoring results than the existing scanning method.

Other advantages, objectives and characteristics of the present invention will be partly embodied by the following description, and partly understood by those skilled in the art through research and practice of the present invention.

1—ultrasonic monitoring device, 2—ground control system, 3—drilling fluid, 4—drilling tool, 5—emitted wave, 6—reflected wave, 11—cylindrical body, 12—lifting cap, 13—lifting bail, 14—centralizer, 15—mounting groove 1, 16—electric push rod, 17—ribbed plate, 18—bolt, 19—mounting groove 2, 20—ultrasonic transducer, 21—bolt, 22—cable hole.

DETAILED DESCRIPTION

In the following detailed description of the preferred embodiments of the present invention, reference is made to the accompanying drawings. It is to be understood that the preferred embodiments described herein are only used to illustrate and interpret the present invention and are not intended to limit the present invention.

I. The monitoring principle of the ultrasonic monitoring wellbore anti-collision monitoring system in the present invention is described as follows:

S wave normal probe comprises two parts: emitting and receiving ultrasonic wave. The distance between the adjacent well and the well under drilling can be calculated according to the time difference between emitting and receiving.

The ultrasonic probe is a reversible acoustic-electric conversion element. Direct piezoelectric effect: the process of converting electrical signal into ultrasonic signal is an ultrasonic emission process. Inverse piezoelectric effect: the process of converting ultrasonic signal into electrical signal is an ultrasonic receiving process.

Figure 1:
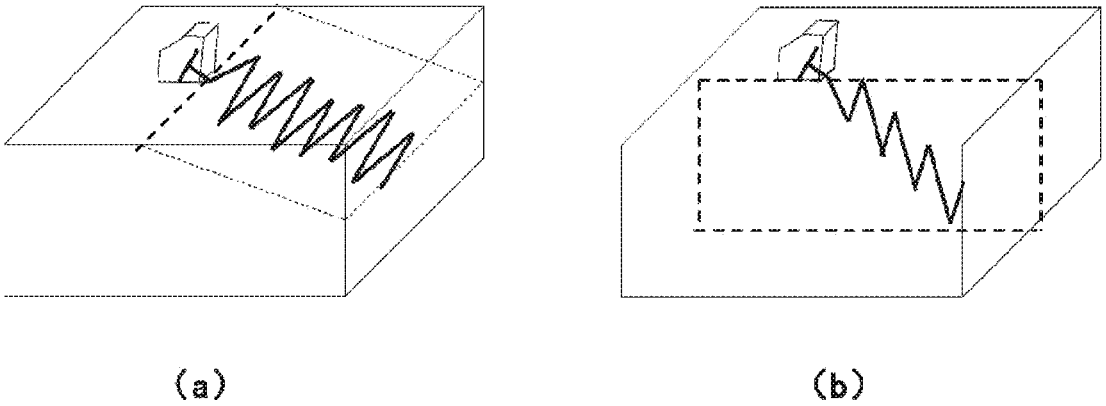
FIG. 1: Schematic Diagram of Vibration Direction of SH Wave and SV Wave; (a) Schematic Diagram of Vibration Direction of SH Wave, (b) Schematic Diagram of Vibration Direction of SV Wave

Ultrasonic S waves are divided into horizontally polarized S wave (SH wave) and vertically polarized S wave (SV wave), as shown in FIG. 1. In the testing industry, if the vibration direction of S wave is parallel to the workpiece surface, it is defined as SH wave (FIG. 1*a*); if perpendicular to the workpiece surface, it is defined as SV wave (FIG. 1*b*).

In the traveling process, ultrasonic SV wave will be converted into refracted P wave and refracted SH wave. In the detection, all kinds of waves will interfere with each other, and the wave will be attenuated greatly. Therefore, this wave is not suitable for detecting the distance between two wells. Compared with SV waves, SH wave will not be converted in the whole traveling process. In the detection, only SH wave will travel and will be attenuated slightly. Therefore, this wave is suitable for detecting the distance between two wells.

Figure 2:
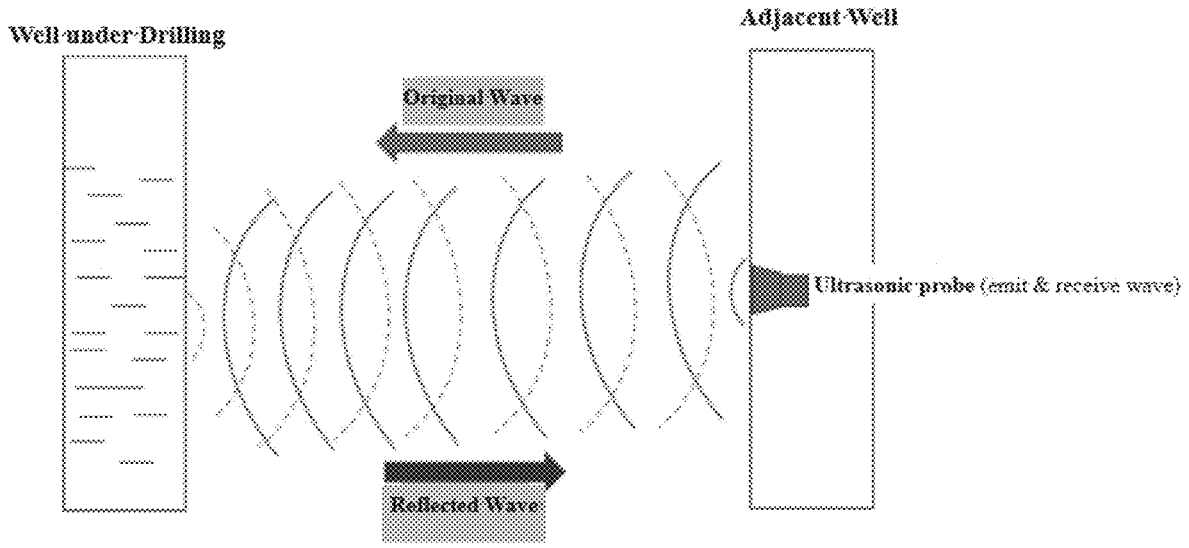
FIG. 2: Schematic Diagram of Distance between Adjacent Wells under Ultrasonic Monitoring

As shown in FIG. 2, the present invention adopts ultrasonic S wave probe. Ultrasonic S wave is emitted perpendicular to the surface of the casing of the adjacent well, and travels in the formation. If encountering the drilling fluid in the well under drilling, S wave cannot continue to travel, but is reflected back by drilling fluid along the original path. The ground control system calculates the distance S between the two wells by monitoring the time difference T between the emission time and the reflection time of the S wave and the travel velocity V of the S wave in the formation; the calculation formula is $$S = \frac{V \times T}{2}.$$

Refer to Table 1 for the travel velocity of ultrasonic wave (S wave and P wave).

TABLE 1

Travel Velocity of Ultrasonic S Wave and P Wave

| Medium | Travel velocity of P wave (m/s) | Travel velocity of S wave (m/s) | Density (kg/) | Radius (cm) |
|---|---|---|---|---|
| Wellbore fluid | 1500 | — | 1000 | 6 |
| Exploring tube | 5900 | 3300 | 7800 | 7 |
| Cement | 2800 | 1700 | 1900 | 10 |
| Formation | 3600 | 2200 | 2300 | ∞ |

Figure 3:
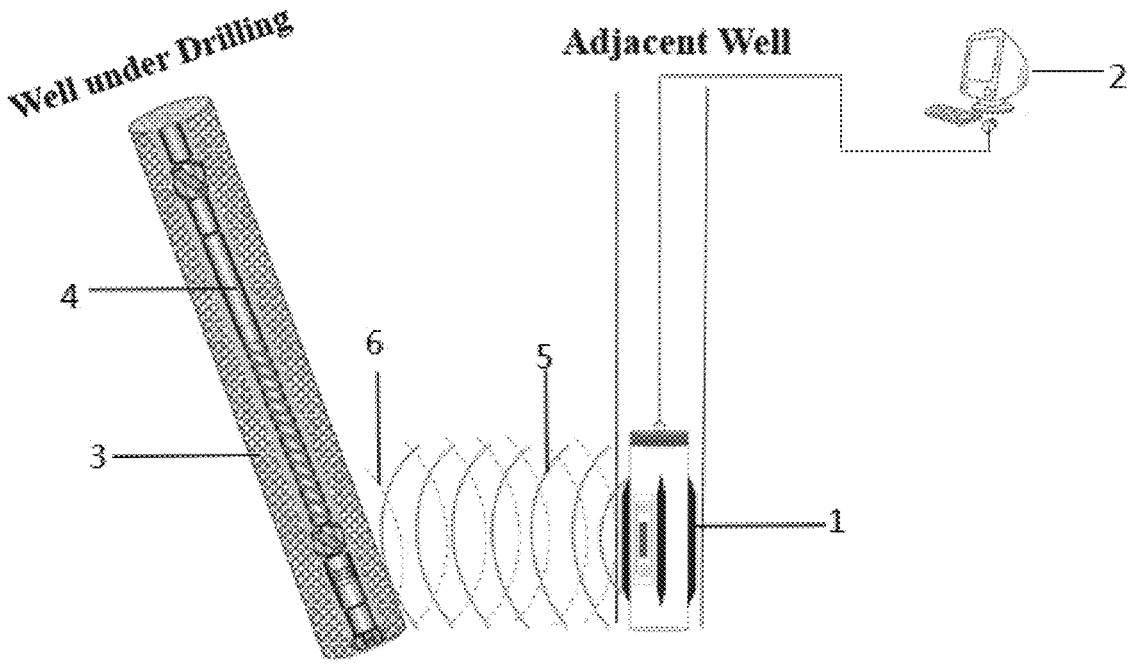
FIG. 3: Schematic Diagram of Ultrasonic Wellbore Anti-collision Monitoring System

II. The device structure of the ultrasonic wellbore anti-collision monitoring system disclosed by the present invention is as follows:

As shown in FIG. 3, the ultrasonic wellbore anti-collision monitoring system includes ultrasonic monitoring device (1) which is placed in adjacent well and ground control system (2). In the figure, 3 is the drilling fluid, 4 is the drilling tool, 5 is the emitted wave, and 6 is the reflected wave.

Figure 4:
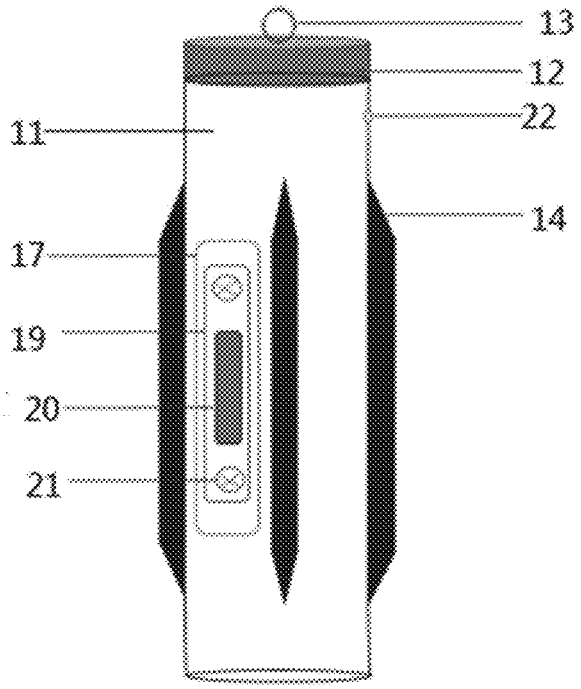
FIG. 4: Structure Diagram of Ultrasonic Monitoring Device
Figure 5:
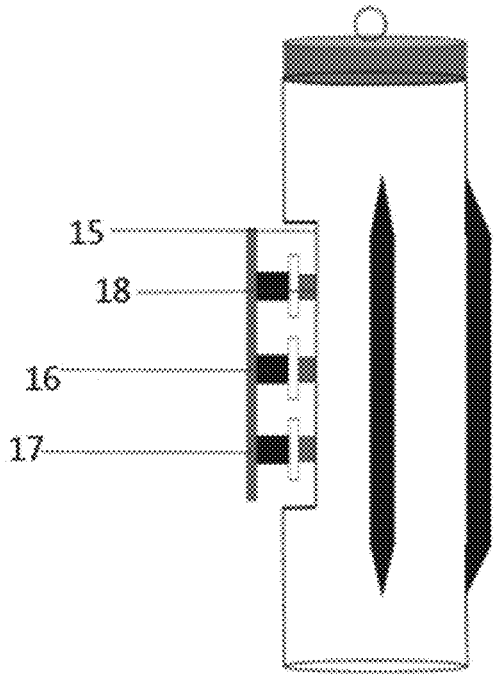
FIG. 5: Structure Diagram of Electronically Controlled Expansion Device of Ultrasonic Monitoring Device
Figure 6:
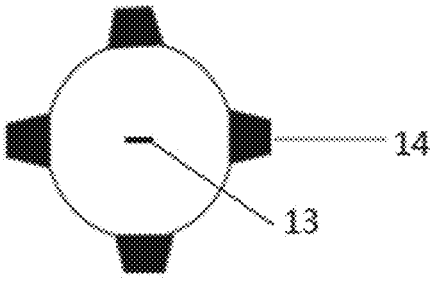
FIG. 6: Top View of Ultrasonic Monitoring Device
Figure 7:
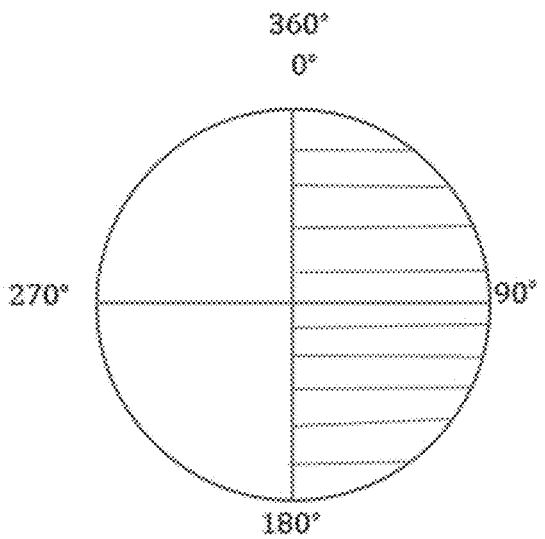
FIG. 7: Schematic Diagram of Wellhead Orientation of Two Adjacent Wells Explanation of numbers marked in the figure.
Figure 7:
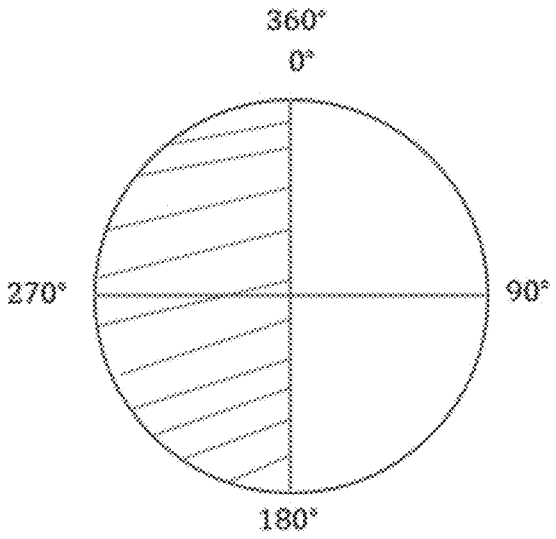

The structure of the ultrasonic monitoring device 1 is shown in FIGS. 4 to 6, including a cylindrical body (11), a lifting cap (12) arranged on the top of the body, and a lifting bail (13) arranged on the top of the lifting cap for connecting the ground drawworks. The preferred structure is that the upper end of the cylindrical body is provided with a box, the lifting cap is provided with a pin, the body is connected with the lifting cap by thread, and a lifting bail is arranged on the top of the lifting cap and connected with the ground drawworks to lift up and lower the ultrasonic monitoring device.

The surface of the cylindrical body (11) is fixed with 4 strip centralizers (14), and the axis of the strip centralizers is parallel to the axis of the cylindrical body. The mounting groove 1 (15) is cut into the cylindrical body surface between two adjacent centralizers, one electrically controlled expansion device is installed in the groove 1 and includes three electric push rods (16) placed horizontally and a ribbed plate (17) perpendicular to the electric push rods. For example, the electric push rods can be those produced by Shandong Jinniu Transmission Technology Co., Ltd., or other electric push rods with a similar structure. the bottom ends of the electric push rods are fixedly connected to the bolts (18) on the bottom of the mounting groove 1, the front ends of the three electric push rods are fixedly connected with the ribbed plate, the mounting groove 2 (19) is cut into the ribbed plate, and the ultrasonic transducer (20) is fixed and installed in the groove 2 by the bolts (21). The front end of the ultrasonic transducer protrudes from the surface of the ribbed plate. The ultrasonic transducer is used to generate ultrasonic S wave (SH wave) and receive the reflected S wave. Ultrasonic S wave can only travel in solid media, and cannot travel and be reflected back in liquids and air. The ultrasonic S wave does not undergo waveform conversion and travels in simple SH waveform in the whole travel process, which makes the SH wave is not interfered by other waves during the travel process. With the increase of travel distance, the attenuation of this wave is much smaller than other waves. Therefore, this wave is most suitable for detecting the distance between two wells.

The electronically controlled expansion device is connected to the ground control system to control the extension and retraction of the electric push rod. There is at least one electric push rod that is synchronized to expand and retract and is connected to the ribbed plate in a uniform distribution. The present disclosure does not limit a count of the electric push rods. Taking three electric push rods as an example, the three electric push rods may include an electric push rod 1, an electric push rod 2, and an electric push rod 3. As shown in FIG. 5, the front end of the electric push rod 1 is connected to a geometric center point of the ribbed plate, and the electric push rod 2 and the electric push rod 3 are respectively located on different sides of the electric push rod 1 and are connected to the ribbed plate in an equidistant distribution. The three electric push rods are extended and retracted at the same time. When the electric push rods are closed, they are in the retracted state, the ribbed plate coincides with the surface of the cylindrical body, and the horizontal protruding height of the ultrasonic transducer is smaller than the horizontal height of two centralizers adjacent to it. When the electric push rods are opened, they are in the extended state, the horizontal protruding height of the ultrasonic transducer is equal to the horizontal height of two centralizers adjacent to it, and the ultrasonic transducer is just close to the wellbore casing. At this time, the ground control system controls the ultrasonic transducer to emit S wave and receive the reflected wave, and calculates the distance between the two wells by monitoring the time difference between the emission time and the reflection time in combination with the travel velocity of S wave in the formation. The two centralizers adjacent to the ultrasonic transducer are made of hard material, and the rest are made of elastic material, so that they are not easy to deform under the action of external force and capable of effectively protecting the ultrasonic sensor when the device is lifted or lowered. The other two centralizers have low hardness and are easy to deform under the action of external force. The upper part of the cylindrical body is provided with a cable hole 22 through which the cable is connected to the ground control system and the downhole ultrasonic monitoring device.

III. With the an-collision monitoring method by the ultrasonic wellbore anti-collision monitoring system, the main technical solution is that the ultrasonic monitoring device is lowered by the drawworks to the specified vertical depth (where the two wells are closest) in the well adjacent to the well under drilling, the ultrasonic transducer is supported on the casing wall of the adjacent well, the ultrasonic monitoring device is controlled by the ground control system to emit S wave perpendicular to the casing wall of the adjacent well, the S wave encounters the drilling fluid in the well under drilling during the travel, and cannot continue to travel, but is reflected back along the original path, and the ground control system calculates the distance S between the two wells by monitoring the time difference T between the emission time and the reflection time of the S wave and the travel velocity V of the S wave in the formation; the calculation formula is $$S = \frac{V \times T}{2}.$$

Monitoring mode varies with the type of well interval. The details are described as follows:

(1) It is very important to prevent the wellbore from collision in the vertical interval, and the collision prevention of the vertical interval is the basis of all works. The inclination of the vertical interval is small, the azimuth changes greatly, and the azimuth change does not affect the measurement. For the wellbore anti-collision monitoring in the vertical interval, the real-time monitoring mode is adopted, including the following steps:

Step 1: Calculate the vertical depth a of measuring point with track calculation software according to inclination and azimuth measured by MWD of the well under drilling;

Step 2: Lower the ultrasonic monitoring device by the drawworks to the vertical depth a calculated in Step 1;

Step 3: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells;

Step 4: After completing Steps 1 to 3, control the closing of the electric push rods with the ground control system, lower the ultrasonic monitoring device by the drawworks at a velocity that is same with drilling rate of the well under drilling until it runs into the well 2 m deep, and then repeat Steps 3 and 4 in turns to continue to measure the distance between the two wells in the vertical interval;

Step 5: After the measurement is completed, control the closing of the electric push rods with the ground control system, start up the drawworks to lift up the ultrasonic monitoring device and lift it away from the wellhead.

(2) If there is collision risk between the well under drilling and the adjacent well in the kick-off interval, collision prevention and obstacle avoidance are particularly important. At this time, it is necessary to not only ensure that the kick-off rate meets the design requirements, but also consider the risk of collision with the adjacent well. There are errors in the measured data of MWD and in the calculated results of the track calculation software. Therefore, it is particularly important to accurately measure the distance between the two adjacent wells. For the wellbore anti-collision monitoring in the kick-off interval, the precise measurement mode is adopted, including the following steps:

Step 1: Calculate the track parameter with track calculation software according to downhole inclination and azimuth measured by MWD of the well under drilling;

Step 2: Calculate the nearest distance between the well under drilling and the adjacent well by anti-collision scanning, work out the vertical depth a and azimuth b of the nearest point of the well under drilling to the adjacent well, and then calculate the monitoring azimuth c of the adjacent well; if the currently measured azimuth is 0° to 180°, c=360°−b; if 180° to 360°, c=b. It should be noted that if the azimuth of the well under drilling is in the range of 0° to 180°, the monitoring device is also lowered according to the azimuth of the well under drilling, and the orientation of the device is exactly opposite to that of the well under drilling;

Step 3: Use a compass to determine the position d of the measured azimuth c measured at the wellhead of the adjacent well, to align the position of the ultrasonic transducer with the position d;

Step 4: Lower the ultrasonic monitoring device by the drawworks to the vertical depth a according to the requirements set forth in Step 3;

Step 5: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells; after that, lift up the ultrasonic monitoring device and lift it away from the wellhead to monitor the next point, and repeat Steps 1 to 5.

(3) For the anti-collision monitoring of the interval with higher risk of collision, real-time monitoring+single-point accurate measurement is adopted. The purpose of real-time monitoring is to monitor the collision trend of adjacent wellbores. For well intervals with a tendency to collide, an accurate measurement mode is used to accurately measure the distance between two wells, including the following steps:

Step 1: Calculate the vertical depth a of measuring point with track calculation software according to inclination and azimuth measured by MWD of the well under drilling;

Step 2: Lower the ultrasonic monitoring device by the drawworks to the vertical depth a calculated in Step 1;

Step 3: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells;

Step 4: After completing Steps 1 to 3, control the closing of the electric push rods with the ground control system, lower the ultrasonic monitoring device by the drawworks at a velocity that is same with drilling rate of the well under drilling until it runs into the well 2 m deep, and then repeat Steps 3 and 4 to conduct real-time monitoring;

Step 5: In the process of real-time monitoring, if there is a trend of collision between the two wells, that is, the distance between the two wells is continuously decreased, switch to the precise measurement mode, and lift up the ultrasonic monitoring device and lift it away from the wellhead as follows:

Step 51: Calculate the track parameter with track calculation software according to downhole inclination and azimuth measured by MWD of the well under drilling;

Step 52: Calculate the nearest distance between the well under drilling and the adjacent well by anti-collision scanning, work out the vertical depth a and azimuth b of the nearest point of the well under drilling to the adjacent well, and then calculate the monitoring azimuth c of the adjacent well; if the currently measured azimuth is 0° to 180°, c=360°−b; if 180° to 360°, c=b;

Step 53: Use a compass to determine the position d of the measured azimuth c measured at the wellhead of the adjacent well, to align the position of the ultrasonic transducer with the position d;

Step 54: Lower the ultrasonic monitoring device by the drawworks to the vertical depth a according to the requirements set forth in Step 3;

Step 55: Control the opening of the electric push rods with the ground control system to make the ultrasonic transducer close to the casing wall in the adjacent well, and then the ultrasonic transducer emits S wave and receives the reflected waves at the same time, and transmits the emitted and reflected wave signals to the ground control system to calculate the distance between the two wells; after that, lift up the ultrasonic monitoring device and lift it away from the wellhead to monitor the next point, and repeat Steps 1 to 5.

The above are only the preferred embodiments of the present invention, and are not intended to limit the present invention in any form. Although the present invention has been disclosed as above with the preferred embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

We claim:

1. An ultrasonic wellbore anti-collision monitoring system, comprising a downhole ultrasonic monitoring device and a ground control system, wherein the ultrasonic monitoring device includes a cylindrical body, a lifting cap is arranged on the top of the cylindrical body, and a lifting bail for connecting ground drawworks is arranged on the top of the lifting cap;

at least three centralizers are fixed on the cylindrical body at an equal interval, a first mounting groove is cut into a cylindrical body surface between two adjacent centralizers of the at least three centralizers, an electronically controlled expansion device is installed in the first mounting groove and includes electric push rods placed horizontally and a ribbed plate perpendicular to the electric push rods, bottom ends of the electric push rods are fixedly connected to a bottom surface of the first mounting groove, front ends of the electric push rods are connected with the ribbed plate, a second mounting groove is cut into the ribbed plate, and a ultrasonic transducer is installed in the second mounting groove; the electronically controlled expansion device is connected to the ground control system to control an extension and a retraction of the electric push rods; when the electric push rods are retracted, a horizontal protruding height of the ultrasonic transducer protruding from the surface of the cylindrical body is smaller than horizontal heights of the two adjacent centralizers adjacent to the ultrasonic transducer; when the electric push rods are extended, the horizontal protruding height of the ultrasonic transducer protruding from the surface of the cylindrical body is equal to the horizontal heights of the two adjacent centralizers adjacent to the ultrasonic transducer, and the ultrasonic transducer is close to a wellbore casing; the ground control system controls the ultrasonic transducer to emit an S wave and receive a reflected wave, and calculate a distance between a well being drilled and a well adjacent to the well being drilled by monitoring a time difference between an emission time and a reflection time in combination with a travel velocity of the S wave in the formation; and the two adjacent centralizers adjacent to the ultrasonic transducer are made of a hard material, and a remainder of the at least three centralizers is made of an elastic material; the cylindrical body is connected with the lifting cap, and the lifting bail is arranged on the top of the lifting cap and connected with the ground drawworks to lift the ultrasonic monitoring device up and down; the at least three centralizers include four centralizers in an elongated shape and with axes parallel to the axis of the cylindrical body.

2. The ultrasonic wellbore anti-collision monitoring system according to claim 1, wherein an upper part of the cylindrical body is provided with a cable hole through which a cable is connected to the ground control system and the downhole ultrasonic monitoring device.

3. A monitoring method using an ultrasonic wellbore anti-collision monitoring system, wherein an ultrasonic monitoring device is lowered by drawworks into a well adjacent to a well being drilled and emits an S wave perpendicular to a casing wall of the well adjacent to the well being drilled; under such condition, during a travel the S wave encounters a drilling fluid in the well being drilled, and cannot continue to travel, but is reflected back along an original path, and a ground control system calculates a distance S between the well being drilled and the well adjacent to the well being drilled by monitoring a time difference T between an emission time and a reflection time of the S wave and a travel velocity V of the S wave in the formation; the calculation formula is $$S = \frac{V \times T}{2};$$

for different types of well intervals, operations are as follows:

a real-time monitoring mode adopted for a wellbore anti-collision monitoring in a vertical interval, including the following steps:

Step a1: calculating a vertical depth a of a measuring point according to inclination and azimuth measured by MWD of the well being drilled;

Step a2: lowering the ultrasonic monitoring device by the drawworks to the vertical depth a calculated in step a1;

Step a3: controlling electric push rods to be extended by the ground control system to move an ultrasonic transducer close to a casing wall of the well adjacent to the well being drilled, and then the ultrasonic transducer emitting the S wave and receiving the reflected waves, and transmitting the emitted and reflected wave signals to the ground control system to calculate the distance between the well being drilled and the well adjacent to the well being drilled;

Step a4: after completing Steps a1 to a3, controlling the electric push rods to be retracted by the ground control system, lowering the ultrasonic monitoring device by the drawworks until the ultrasonic monitoring device moves down 2 meters into the well adjacent to the well being drilled and then stopping lowering ultrasonic monitoring device, a lowering speed of the ultrasonic monitoring device being the same as a drilling speed of the well being drilled, and then repeating Steps a3 and a4 in turn to continue to measure the distance between the well being drilled and the well adjacent to the well being drilled in the vertical interval;

Step a5: after measuring the distance between the well being drilled and the well adjacent to the well being drilled in the vertical interval, controlling the electric push rods to be closed by the ground control system, starting up the drawworks to lift up the ultrasonic monitoring device and lift the ultrasonic monitoring device away from a wellhead;

wellbore anti-collision monitoring for a deflection interval including the following steps:

Step b1: obtaining downhole inclination and azimuth measured by the MWD of the well being drilled;

Step b2: calculating, by anti-collision scanning, a nearest distance between the well being drilled and the well adjacent to the well being drilled, working out a vertical depth a and an azimuth b of a nearest point of the well being drilled to the well adjacent to the well being drilled, and then calculating a monitoring azimuth c of the well adjacent to the well being drilled; if a currently measured azimuth is 0° to 180°, c=360°−b; if the currently measured azimuth is 180° to 360°, c=b;

Step b3: using a compass to determine a position d of the measured azimuth c measured at the wellhead of the well adjacent to the well being drilled, and aligning the position of the ultrasonic transducer with the position d;

Step b4: lowering the ultrasonic monitoring device by the drawworks to the vertical depth a according to the requirements set forth in Step b3;

Step b5: controlling the electric push rods to be extended by the ground control system to move the ultrasonic transducer close to the casing wall of the well adjacent to the well being drilled, and then the ultrasonic transducer emitting the S wave and receiving the reflected waves, and transmitting the emitted and reflected wave signals to the ground control system to calculate the distance between the well being drilled and the well adjacent to the well being drilled; after that, lifting up the ultrasonic monitoring device and lifting the ultrasonic monitoring device away from the wellhead to monitor a next point, and repeating Steps b1 to b5, a real-time monitoring and single-point accurate measurement adopted for an anti-collision monitoring of an interval with higher risk of collision, including the following steps:

Step c1: calculating a vertical depth a of a measuring point according to inclination and azimuth measured by the MWD of the well being drilled;

Step c2: lowering the ultrasonic monitoring device by the drawworks to the vertical depth a calculated in Step c1;

Step c3: controlling the electric push rods to be extended by the ground control system to move the ultrasonic transducer close to the casing wall of the well adjacent to the well being drilled, and then the ultrasonic transducer emitting the S wave and receiving the reflected waves, and transmitting the emitted and reflected wave signals to the ground control system to calculate the distance between the well being drilled and the well adjacent to the well being drilled;

Step c4: after completing Steps c1 to c3, controlling the electric push rods to be retracted by the ground control system, lowering the ultrasonic monitoring device by the drawworks until the ultrasonic monitoring device moves down 2 meters into the well adjacent to the well being drilled and then stopping lowering ultrasonic monitoring device, a lowering speed of the ultrasonic monitoring device being the same as a drilling speed of the well being drilled, and then repeat Steps c3 and c4 to conduct real-time monitoring;

in the process of the real-time monitoring, if there is a trend of collision between the well being drilled and the well adjacent to the well being drilled, that is, the distance between the well being drilled and the well adjacent to the well being drilled is continuously decreased, switching to a precise measurement mode, and lifting up the ultrasonic monitoring device and lifting the ultrasonic monitoring device away from the wellhead as follows:

Step d1: obtaining downhole inclination and azimuth measured by the MWD of the well being drilled;

Step d2: calculating, by anti-collision scanning, a nearest distance between the well being drilled and the well adjacent to the well being drilled, working out a vertical depth a and an azimuth b of a nearest point of the well being drilled to the well adjacent to the well being drilled, and then calculating a monitoring azimuth c of the well adjacent to the well being drilled; if a currently measured azimuth is 0° to 180°, c=360°−b; if the currently measured azimuth is 180° to 360°, c=b;

Step d3: using a compass to determine a position d of the measured azimuth c measured at the wellhead of the well adjacent to the well being drilled, and aligning the position of the ultrasonic transducer with the position d;

Step d4: lowering the ultrasonic monitoring device by the drawworks to the vertical depth a according to the requirements set forth in Step d3;

Step d5: controlling the electric push rods to be extended by the ground control system to move the ultrasonic transducer close to the casing wall of the well adjacent to the well being drilled, and then the ultrasonic transducer emitting the S wave and receiving the reflected waves, and transmitting the emitted and reflected wave signals to the ground control system to calculate the distance between the well being drilled and the well adjacent to the well being drilled; after that, lifting up the ultrasonic monitoring device and lifting the ultrasonic monitoring device away from the wellhead to monitor a next point, and repeating Steps c1 to c4.

* * * * *